United States Patent [19]

Gibert

[11] 4,401,408

[45] Aug. 30, 1983

[54] ARTICULATED VEHICLE

[76] Inventor: Pierre Gibert, Saint-Cerques, F-74170 Douvaine, France

[21] Appl. No.: 290,463

[22] Filed: Aug. 6, 1981

[30] Foreign Application Priority Data

Aug. 14, 1980 [FR] France ..... 80 18027

[51] Int. Cl.[3] ..... E02F 3/75

[52] U.S. Cl. ..... 414/687; 212/189; 280/764.1; 180/8 C; 180/134; 254/423

[58] Field of Search ..... 414/685, 687; 212/189; 180/8 C, 134, 139; 280/764; 254/86 H, 87

[56] References Cited

U.S. PATENT DOCUMENTS

| | | | |
|---|---|---|---|
| 3,528,675 | 9/1970 | Brown | 212/189 X |
| 3,608,756 | 9/1971 | Guinot | 212/189 X |
| 3,777,898 | 12/1973 | Gallay | 212/189 |
| 4,082,197 | 4/1978 | Stedman | 414/687 |
| 4,147,262 | 4/1979 | Umeda et al. | 414/687 |
| 4,345,873 | 8/1982 | Wymore | 212/189 X |

*Primary Examiner*—Robert J. Spar
*Assistant Examiner*—Terrance L. Siemens
*Attorney, Agent, or Firm*—Dowell & Dowell

[57] ABSTRACT

The present invention relates to an articulated vehicle comprising a first frame assembly including a first pair of road wheels; an upwardly protruding vertical pivot fixed to the first frame assembly; a second frame assembly including a substantially horizontal beam having a first and a second ends, with the first end being formed with bearings mounted on the pivot and with the beam extending horizontally above the first frame assembly, a support fixed to the second end of the beam, the support including a second pair of road wheels; apparatus to rotate the second frame assembly about the pivot relative to the first frame assembly; a boom pivoted to the second frame assembly about a horizontal axis; apparatus to raise and lower the boom relative to the second frame assembly; ground engaging elements to support said vehicle; connectors to connect ground engaging elements with the first frame assembly while permitting vertical displacement of the ground engaging elements relative to said first frame assembly; and apparatus to displace the ground engaging elements relative to the first frame assembly between a retracted position for which said ground engaging elements are raised with respect to the first frame assembly, with the wheels of the first and second pair resting on the ground to support the vehicle, and an expanded position for which the wheels of the first and second pairs are raised above ground, the vehicle being wholly supported by the ground engaging elements.

2 Claims, 4 Drawing Figures

ARTICULATED VEHICLE

This invention relates to vehicles such as mobile cranes, excavators and the like, having a boom pivotally mounted on a wheeled frame so as to be able to rotate thereon about a vertical axis.

In such vehicles it is known to construct the frame in articulated form. Such an articulated frame thus comprises first and second assemblies which are pivotally connected with each other about a vertical axis, each having a pair of wheels. When the vehicle is running on a road or the like, steering is obtained by positively angling the second frame assembly relatively to the first one, as for instance by means of hydraulic cylinders. When the boom or the work implement which it carries (bucket or the like) is to be used, the second frame assembly is raised by means of appropriate ground engaging means in such manner that it may freely rotate about the first one. The boom may thus be directly supported by this rotatable second frame assembly, which eliminates any particular pivoting mechanism for the said boom and simplifies the construction. But the possible angle of rotation thus provided for the boom is limited and this is an inconvenience in many instances.

In accordance with the present invention the second frame assembly comprises a substantially horizontal beam having one end mounted on a pivot which extends upwardly from the first frame assembly, the other end of this beam being fixed to a frame member which carries the second pair of wheels and the horizontal pin adapted to pivotally support the boom. With such an arrangement the angle of rotation of the second frame assembly relatively to the first one may easily exceed 180° (90° each side of the mean or aligned position).

The ground engaging means are preferably made in the form of a particular frame which is connected with the first frame assembly by means of articulated parallelograms respectively disposed each side of the vehicle, the arrangement being such that when the said ground engaging frame is lowered, it is simultaneously displaced horizontally towards the second frame assembly. With such an arrangement when the said ground engaging frame is in its lowered position, its rear end may be situated more or less below the wheels of the second assembly, which improves the supporting action.

Figure 1:
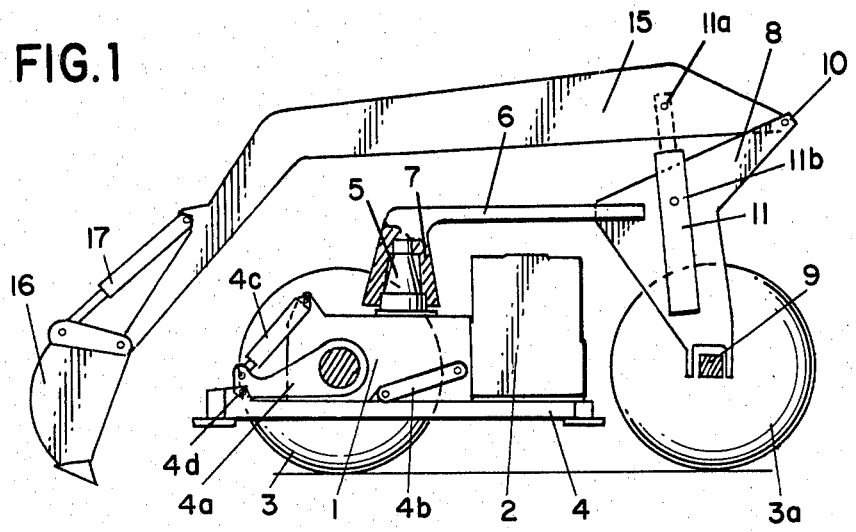
FIG. 1 is a side view with parts in section illustrating a vehicle according to the invention with its wheels resting on the ground.
Figure 2:
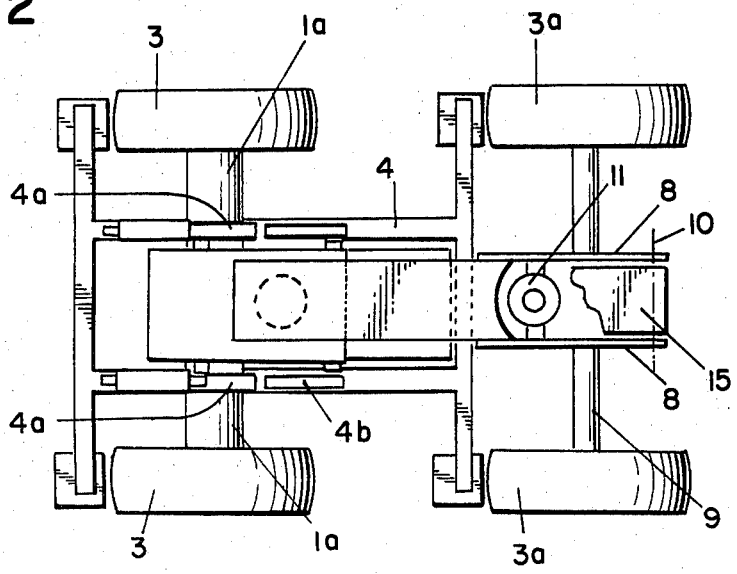
FIG. 2 is the corresponding plan view with the boom in part omitted.
Figure 3:
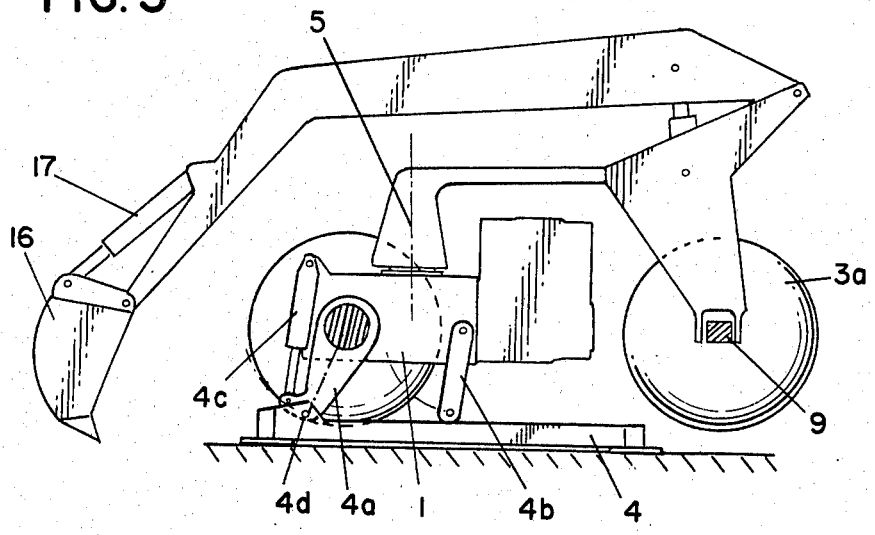
FIG. 3 is a side view with parts in section showing the vehicle resting on its ground engaging frame.

As illustrated in FIGS. 1 to 3 the vehicle comprises a gear box 1 secured to an engine 2 to form the first or front assembly of the frame. This gear box rotatably supports the axles 1*a* of the driving wheels 3. The first assembly further includes on each side of the vehicle hinged arms 4*a* and 4*b* which connect gear box 1 with a ground engaging frame 4 controlled by hydraulic cylinders 4*c*, said arms being of equal length and parallel to each other to form an articulated parallelogram. It will be observed that arm 4*a* is rotatably mounted on the adjacent axle 1*a*, its other end being pivoted to frame 4 at 4*d*. Gear box 1 also supports an upwardly protruding vertical pivot 5 adapted to connect the first or front assembly of the vehicle frame with the second or rear assembly. This latter comprises a rigid beam 6 formed at its front end with a conical bearing box 7 mounted on pivot 5, and two spaced side members or cheeks 8 fixed to the other or rear end of beam 6. Members 8 support the rear axle 9 with the steering wheels referenced 3*a*, and the horizontal pin 10 of the boom 15, a hydraulic cylinder 11 being pivotally connected at 11*a* with the said boom and at 11*b* with side members 8 to vertically actuate boom 15.

In the example illustrated the boom 15 carries a bucket 16 controlled by a hydraulic cylinder 17.

Figure 4:
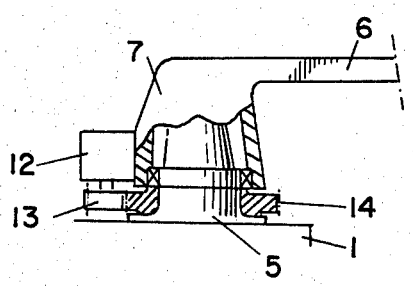
FIG. 4 illustrates in section an embodiment of the pivot which connects the first and the second frame assemblies.

FIG. 4 illustrates an embodiment of the mechanism used to rotate the rear or second frame assembly relatively to the front or first one. A hydraulic motor 12, fixed to the bearing box 7 has on its outlet shaft a pinion 13 which meshes with a toothed crown 14 fixed to pivot 5, i. e. to gear box 1.

When the vehicle is running on a road or the like, the ground engaging frame 4 is at its raised or retracted position, the wheels 3 and 3*a* resting on the ground (position of FIG. 1). Steering is then effected by means of motor 12. When the bucket 16 is to be used, cylinders 4*c* are actuated to lower the ground engaging frame 4, i.e. to bring same to its expanded position, as illustrated in FIG. 3. The vehicle is thus lifted as a whole, the wheels 3 and 3*a* being well above ground. Boom 15 may then be rotated at will together with second frame assembly 6–8 here again under the action of motor 12.

Since beam 6 is well above the first frame assembly 1–2, it may freely rotate through any angle desired. In fact it is possible for the second frame assembly 6–8 to rotate a full 360° about the pivot 5 of the first frame assembly 1–2;

It is also to be noted that when the ground engaging frame 4 is being lowered, arms 4*a* and 4*b* are rotated counterclockwise in FIGS. 1 and 3, which means that the ground engaging frame 4 is displaced horizontally towards the right, that is towards the second frame assembly 6–8. The rear end of frame 4 may thus come in part below the rear wheels 3*a*, as clearly shown in FIG. 3, to support the weight of the vehicle in a particularly efficient manner. Frame 4 may be provided with a rectangular shape, as clearly apparent in FIG. 2, which improves its rigidity. As illustrated in this figure, the rear transverse side of this rectangle may be situated in front of wheels 3*a* when the said frame 4 is at its retracted position.

I claim:

1. An articulated vehicle, comprising:

(a) a first frame assembly including a first pair of ground engaging wheels, and including a vertical pivot fixed to the first frame and extending upwardly therefrom;

(b) a rigid beam having a first end carrying bearing means journalled on said pivot and the beam extending from its first end located at the pivot, above said first frame assembly, to a second end located horizontally beyond the first frame assembly;

(c) a second frame assembly including a frame member fixed to the second end of the beam and carrying a pair of ground engaging wheels, the frame member being carried by the beam in a position located horizontally beyond the first frame assembly thereby to permit the beam and the second frame assembly to be rotated about said pivot relative to said first frame assembly;

(d) a boom pivotally supported above the wheels of said second frame member for tilting about a horizontal axis, and means to raise and lower the boom about said axis;

(e) a ground engaging support frame, means connecting the support frame with said first vehicle frame assembly, and means operative for selectively displacing the frame to a raised position in which it is elevated above the ground and said pairs of wheels support the vehicle on the ground and operative for selectively displacing the support frame to a lowered position in which it entirely supports the vehicle with said pairs of wheels elevated off the ground; and (f) means for rotating the beam and the second frame assembly about the vertical pivot and the first frame assembly to permit a full 360° of rotation of the second frame assembly about the first frame assembly.

2. In an articulated vehicle as claimed in claim 1, said means to rotate said beam and said second frame assembly about said pivot and said first frame assembly comprising, an hydraulic motor carried by the first end of the beam and having a rotating pinion connected thereto, and a toothed crown fixed with respect to said vertical pivot, said pinion meshing with said crown.

* * * * *